United States Patent [19]

Nitta

[11] Patent Number: 4,929,176

[45] Date of Patent: May 29, 1990

[54] NONCONTROLLING TYPE VALVE

[75] Inventor: Tomio Nitta, Yokohama, Japan

[73] Assignee: Tokai Corporation, Yokohama, Japan

[21] Appl. No.: 342,209

[22] Filed: Apr. 24, 1989

[30] Foreign Application Priority Data

Apr. 27, 1988 [JP] Japan ..... 63-55864[U]

[51] Int. Cl.[5] ..... F23D 14/28

[52] U.S. Cl. ..... 431/344; 137/550; 222/3

[58] Field of Search ..... 137/544, 545, 550; 222/3; 431/344

[56] References Cited

U.S. PATENT DOCUMENTS

| | | | |
|---|---|---|---|
| 3,218,831 | 11/1965 | Newman | 431/344 |
| 3,315,496 | 4/1967 | Newman | 222/3 X |
| 3,523,558 | 8/1970 | Tissot-Dupont | 431/344 X |
| 3,854,862 | 12/1974 | Webster | 431/344 X |
| 3,860,385 | 1/1975 | Nakanishi | 431/344 |
| 3,961,876 | 6/1976 | Chernock | 431/344 |
| 4,478,570 | 10/1984 | Johansson | 431/344 |
| 4,680,007 | 7/1987 | Schächter | 431/344 |

*Primary Examiner*—John Rivell

*Attorney, Agent, or Firm*—Armstrong, Nikaido, Marmelstein, Kubovcik & Murray

[57] ABSTRACT

An improvement of noncontrolling type valve for use in a gas-lighter, a portable cooking stove and other burners, which valve comprises a valve body push-fitted in a recess formed in the top plate of a gas container; and a filter positioned under the valve body to permit a given constant flow of gas to pass to the valve body when the valve opens. The valve is improved according to the present invention in that an annular spacer is fixed to the annular inside edge of the uppersurface of said filter, allowing the bottom end of said valve body to contact the remaining center area of the uppersurface of said filter. The coplanar positioning of the bottom end of the valve body with the annular spacer prevents deformation of the filter even if it is exposed to an increased gas pressure, thereby assuring that the gas flows through the filter at a controlled rate all the time.

8 Claims, 2 Drawing Sheets

NONCONTROLLING TYPE VALVE

BACKGROUND OF THE INVENTION

1. Field of the Invention

The present invention relates to a noncontrolling type valve for use in a gaslighter, a portable cooking stove and other burners. Such a valve permits a given constant amount of gas to flow to the nozzle when the valve opens.

2. Related Art

A conventional noncontrolling type valve is built in a recess formed in the top plate of a gas container. The recess has a through aperture in its bottom to communicate with the inside of the gas container. A valve body is push-fitted in the recess, and porous filter is positioned between the valve body and the through aperture of the recess bottom, not contacting the valve body and the recess bottom, permitting a given constant amount of gas to flow from the through aperture of the recess bottom to the valve when it is opened.

The porous filter is separate from the recess bottom and from the valve bottom. When the valve is opened, the porous filter will be subjected to gas pressure, and accordingly it will be yieldingly bent upwards. Thus, it is liable to be loosened or deformed with the result that the gas-passing area of the filter varies and that the gas flow rate varies accordingly. When the gas pressure in the gas container increases with the increase of surrounding temperature, the length of the nozzle flame will increase and the flame will become unstable.

The liquefied petroleum gas is liable to stay in the through aperture of the recess bottom because the through aperture is closed by a liquid bubble, which is caused by surface tension. Then, an extra amount of heat (evaporation heat) is required to evaporate the gas trapped in the through aperture of the recess bottom. An insufficient amount of heat will cause incomplete evaporation, which is the cause for unstable flame on the nozzle.

SUMMARY OF THE INVENTION

In view of the above one object of the present invention is to provide a noncontrolling type valve guaranteed free from the defects as described above.

To attain this object a noncontrolling type valve comprising: a recess formed in the top plate of a gas container, said recess having a through aperture in its bottom to communicate with the inside of said gas container; a valve body push-fitted in said recess; and a filter positioned below said valve body to permit a given constant flow of gas to pass to said valve body when said valve opens, is improved according to the present invention in that said valve further comprises, in said recess, an annular spacer of a synthetic resin fixed to the annular inside edge of the uppersurface of said filter, the bottom end of said valve body being in contact with the remaining area of the uppersurface of said filter, and the undersurface of said filter being laid across said through aperture of the bottom of said recess, and in that said valve further comprises, in said recess, an O-ring fitted around the bottom end of said valve body and pushed against the uppersurface of said annular spacer and the inner wall of said recess. The filter may be fixed to the undersurface of said annular spacer by thermocompression bonding, ultrasonic welding or impulse welding. The filter may have unwoven cloth on its uppersurface, and the bottom end of the valve body may project downward below the undersurface of the annular spacer to stretch the filter tight, and the through aperture may have a decreased diameter small enough to cause no gas trap due to surface tension.

With this arrangement the liquefied petroleum gas changes from the liquid to gasous phase on the surface of the gas well, and the gas passes through the aperture in the recess bottom and then through the filter. Then, the gas flows at a predetermined flow rate. The gas flows in the channel of the valve stem to flow out in the atmosphere.

The bottom end of the valve body may project downward below the undersurface of the annular spacer to stretch the filter tight. Then, if the gas pressure in the gas container increases with the rise of surrounding temperature, and if the filter is exposed to the increased gas pressure, the filter cannot be yieldingly bent, causing no loosening and deformation of the gas filter and assuring that the gas-passing area of the filter remains constant. The O-ring which is put around the bottom end of the valve body, is pushed against the uppersurface of the annular spacer and the inner wall of the recess to prevent the gas from escaping sideways, thereby assuring that the exact amount of gas is supplied to the nozzle.

The filter may have an unwoven cloth applied to its uppersurface to prevent deformation of the filter even if it is exposed to an increased gas pressure. When the unwoven cloth is pushed closely against the bottom of the valve body, the porousness of the unwoven cloth allows the gas to pass to the valve body at a controlled flow rate. The bottom end of the valve body may project downward below the undersurface of the annular spacer to stretch the filter tight, thereby avoiding the loosening of the filter. The through aperture of the recess bottom may have a diameter small enough to cause no trap of gas due to surface tension.

Other objects an advantages of the present invention will be understood from the following description of the noncontrolling type valves according to preferred embodiments of the present invention, which are shown in accompanying drawings:

PREFERRED EMBODIMENT OF THE INVENTION

Figure 1:
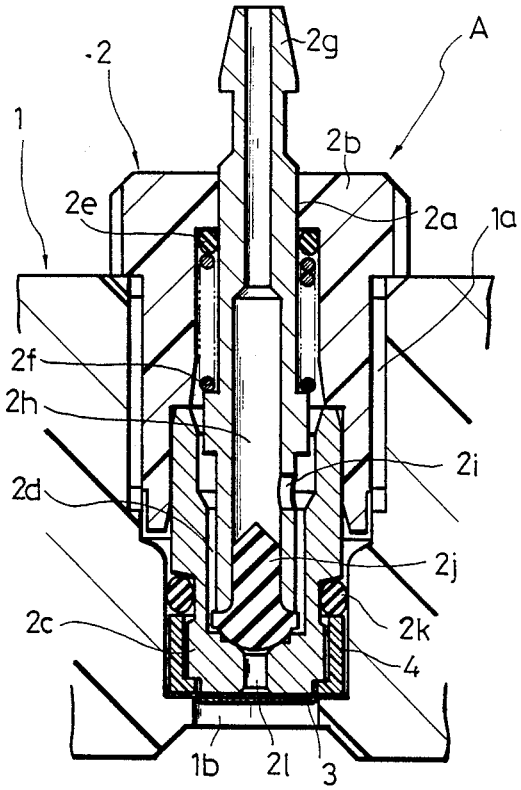
FIG. 1 is a longitudinal section of a noncontrolling type valve according to a preferred embodiment of the present invention.
Figure 2:
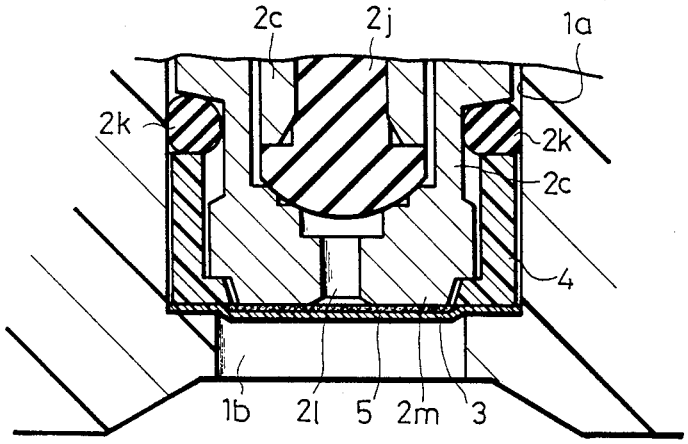
FIG. 2 is an enlarged longitudinal section of the bottom of the valve body of FIG. 1.

FIG. 1 shows a noncontrolling type valve A for use in a gaslighter, a portable cooking stove and other burners as being built in the top plate 1 of a gas container (not shown). Specifically, the top plate 1 is integrally connected by ultrasonic welding to the gas container casing to hermetically close its top. Liquefied petroleum gas is put in the gas container.

As shown, a recess 1*a* is formed in the top plate 1 of the gas container. The recess 1*a* has a through aperture 1b in its bottom to communicate with the inside of the gas container(not shown).

The valve 2 is push-fitted in the recess 1*a*. The valve 2 comprises a cylindrical screw cap 2*b* having an opening 2*a* on its top and threads on its outside, and a cylindrical trunk 2*c* fitted in the bottom of the cylindrical screw cap 2*b*. The cylindrical screw cap 2*b* and the cylindrical trunk 2*c* define a valve compartment 2*d*. A nozzle 2*g* is put in the compartment 2*d* with its tip end 2*g* projecting from the cylindrical screw cap 2*b*. The nozzle 2*g* is biased downward by a spring 2*f*. An O-ring 2*e* is pushed against the ceiling of the valve compartment 2*d* to hermetically close the gap between the nozzle 2*g* and the cylindrical screw cap 2*b*. The nozzle 2*g* has a longitudinal channel 2*h* and a lateral channel 2*i*. The nozzle 2*g* has a rubber plug 2*j* at its bottom to close its longitudinal channel 2*h*. When the nozzle 2*g* is pulled up, the rubber plug 2*j* rises to open the valve opening 21. An O-ring 2*k* is fitted in the circumferential slot of the lower end of the cylindrical trunk 2*c*.

As seen from FIG. 1, a membrane filter 3 is laid across the through aperture 1*b* to permit a given constant flow of gas to pass to the valve. The membrane filter 3 is fixed to an annular spacer 4 of a synthetic resin by thermocompression bonding, ultrasonic welding or impulse welding. The annular spacer 4 bearing the membrane filter 3 is push-fitted in the recess 1*a* until the membrane filter 3 is put in right position. An unwoven cloth 5 may be laid on the uppersurface of the membrane filter 3 to keep a constant flow of gas and thereby obtaining a predetermined hieght of flame without effect according to changes of gas pressure. In the case, preferably the membrane filter 3 is made of microporous film of polypropylene with 0.4×0.04 micron maximum aperture, 45% voids and 25 micron thick.

Figure 3:
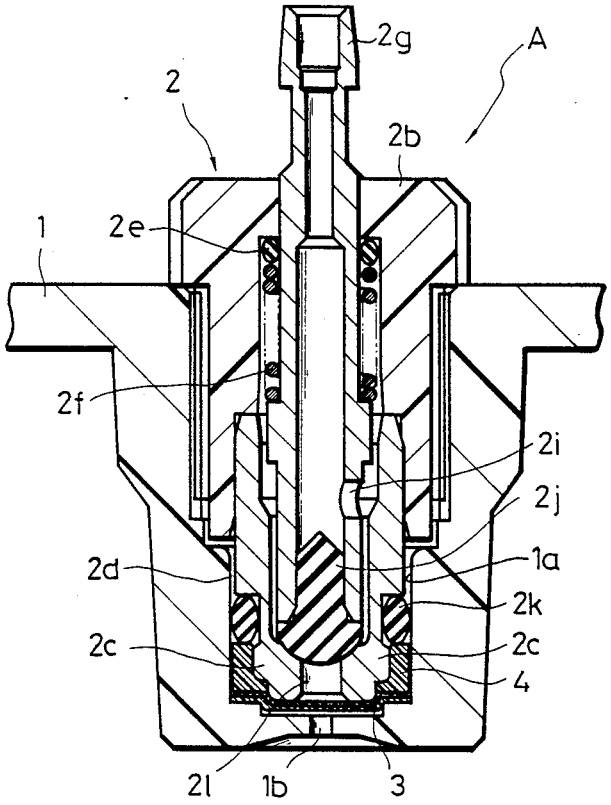
FIG. 3 is a longitudinal section of a noncontrolling type valve according to another embodiment.

The bottom end 2*m* of the valve trunk 2*c* projects downward from the annular spacer 4 to stretch the underlying unwoven cloth 5 and filter 3 (See FIG. 3), thereby preventing the unwoven cloth and filter from loosening in use. The O-ring 2*k* around the valve trunk is pushed against the inner wall of the recess 1*a* and the uppersurface of the annular spacer 4 to prevent the gas from escaping sideways. The through aperture 1*b* of the recess bottom is selected, for instance 0.5 mm across, and then the amount of the gas trapped in the aperture 1*b* due to surface tension will be reduced to minimum.

A lever (not shown) is swingably supported with its end fixed to the neck of the nozzle 2*g*. When the lever is operated to pull up the nozzle 2*g*, the rubber plug 2*j* rises apart from the valve opening 21 to permit the gas to flow to the membrane filter 3.

The liquid petroleum gas changes from the liquid to gasous phase on the surface of gas well. When the valve opens, the gas passes through the aperture 1*b* of the recess bottom, and then through the membrane filter 3. The gas flow rate is selected to form, for instance, a 25 millimeter long flame on the nozzle tip at room temperature. After passing through the unwoven cloth 5 the gas flows in the valve opening 21 of the cylindrical trunk 2*c* and then in the valve compartment 2*d*. Then, the gas flows in the lateral and longitudinal channels 2i and 2*h* of the valve stem 2*a*.

The coplanar arrangement of the bottom end of the valve body with the annular spacer prevents deformation of the filter even if the gas pressure increases with the increase of surrounding temperature, thereby assuring that the gas flows through the filter at a controlled flow rate. Also, the O-ring around the bottom end of the valve body prevents the gas from leaking sideways, and this contributes to the stable supply of the exact amount of gas to the nozzle.

The use of the unwoven cloth on the filter increases the resistance of the filter to deformation against the gas pressure, and the porousness of the unwoven cloth allows the gas to pass therethrough even if it is pushed against the bottom of the valve body.

The projection of the bottom end of the valve body below the level at which the undersurface of the annular spacer lies, keeps the filter stretched tight to prevent the loosening of the filter.

The through aperture of the bottom end of the recess has a diameter small enough to eliminate the possibility of causing the trap of gas due to surface tension, thereby making the flame stable all the time.

I claim:

1. A noncontrolling type valve for a gas container having a top plate, a recess formed in said top plate and said recess having a through aperture in its bottom to communicate with the inside of said gas container comprising: a valve body push-fitted in said recess; and a filter positioned under said valve body for permitting a given constant flow of gas to pass to said valve body when said valve opens, characterized in that said valve further comprises, in said recess, an annular spacer of a synthetic resin fixed to an annular inside edge of an uppersurface of said filter, said valve body having a bottom end in contact with the remaining area of said uppersurface of said filter, said filter having an undersurface laid across said through aperture in the bottom of said recess, said valve further comprising, in said recess, an O-ring fitted around said bottom end of said valve body and pushed against an uppersurface of said annular spacer and an inner wall of said recess.

2. A noncontrolling type valve according to claim 1 wherein said filter is fixed to an underside of said annular spacer by thermocompression bonding, ultrasonic welding or impulse welding.

3. A noncontrolling type valve according to claim 1 or 2 wherein said filter has unwoven cloth on its uppersurface.

4. A noncontrolling type valve according to claim 1 or 2 wherein said bottom end of said valve body projects downward below said undersurface of said annular spacer to stretch said filter tight.

5. A noncontrolling type valve according to claims 1 or 2 wherein said through aperture has a decreased diameter small enough to cause no gas trap due to surface tension.

6. A noncontrolling type valve according to claim 4 wherein said through aperture has a decreased diameter small enough to cause no gas trap due to surface tension.

7. A noncontrolling type valve according to claim 3 wherein said bottom end of said valve body projects downward below said undersurface of said annular spacer to stretch said filter tight.

8. A noncontrolling type valve according to claim 3 wherein said through aperture has a decreased diameter small enough to cause no gas trap due to surface tension.

* * * * *